United States Patent [19]

Bayer et al.

[11] 4,244,646

[45] Jan. 13, 1981

[54] DEVICE AND METHOD FOR PRODUCING A NUMBER OF COPIES BY ELECTROPHOTOGRAPHIC TECHNIQUES

[75] Inventors: Eberhard Bayer; Karl Kempter, both of Munich, Fed. Rep. of Germany

[73] Assignee: Siemens Aktiengesellschaft, Berlin & Munich, Fed. Rep. of Germany

[21] Appl. No.: 12,003

[22] Filed: Feb. 14, 1979

Related U.S. Application Data

[63] Continuation of Ser. No. 821,133, Aug. 2, 1977.

[30] Foreign Application Priority Data

Aug. 9, 1976 [DE] Fed. Rep. of Germany ..... 2635731

[51] Int. Cl.[3] ..... G03G 15/00

[52] U.S. Cl. ..... 355/3 R; 355/67; 430/31

[58] Field of Search ..... 355/3 R, 3 DR, 3 TE, 355/3 TR, 3 BE, 3 SH, 16, 67; 101/DIG. 13; 96/1 R; 430/54, 31

[56] References Cited

U.S. PATENT DOCUMENTS

| | | | |
|---|---|---|---|
| 2,845,348 | 7/1958 | Kallman | 96/1 R |
| 3,267,840 | 8/1966 | Honma et al. | 355/3 BE |
| 3,363,555 | 1/1968 | Olden | 96/1 R |
| 3,364,020 | 1/1968 | Fehlberg et al. | 96/1 R |
| 3,511,649 | 5/1970 | Felty et al. | 96/1 R |
| 3,879,197 | 4/1975 | Bartlett | 96/1 R X |
| 3,918,971 | 11/1975 | Zweig | 355/3 R X |
| 4,047,945 | 9/1977 | Pfister et al. | 96/1 R |

OTHER PUBLICATIONS

*Electrophotography* by R. M. Schaffert, Focal Press, London, 1975, pp. 22-25, 67, 68, 117-124 and 615-617.

*Primary Examiner*—R. L. Moses

*Attorney, Agent, or Firm*—Hill, Van Santen, Steadman, Chiara & Simpson

[57] ABSTRACT

A device for electrophotographically copying wherein for writing a charge pattern into a suitable photo-conductive layer with differing electron mobility and hole mobility a relatively long wave length of light is used which has a penetration depth comparable with the thickness of the layer and which has a quantum energy which corresponds to the energy of deep traps for the less mobile kind of charge carriers. Due to the long life of the charge carriers in the deep traps, the newly applied charges of opposite polarity remain on the exposed locations for a relatively long time since the charge has been caught in the traps whereas the unexposed locations are repeatedly charged again to maintain an undisturbed potential such that the charge pattern is retained for a longer time even with continued exterior charging. So as to erase the charge pattern a correspondingly light beam of shorter wave length is utilized which has a penetration depth that is small relative to the thickness of layer so as to cause the deep traps to be quickly removed through recombination of charges.

9 Claims, 3 Drawing Figures

DEVICE AND METHOD FOR PRODUCING A NUMBER OF COPIES BY ELECTROPHOTOGRAPHIC TECHNIQUES

This is a continuation of application Ser. No. 821,133, filed Aug. 2, 1977.

BACKGROUND OF THE INVENTION

1. Field of the Invention

This invention relates in general to devices for electrophotographically copying.

2. Description of the Prior Art

Devices and processes for electrophotographically copying documents especially printed ones are widely known in the prior art and in particular many publications and patents describing such processes are owned by the Xerox Corporation. In known devices, for electrographically copying documents, a revolvable drum is provided which has a cover surface upon which a layer of material capable of storing electrical charges in the darkness for at least a certain period of time is provided. When the material of the layer is exposed to light of a suitable wave length, the layer takes on photo-conductive properties such that on the exposed locations of the layer on the surface of the layer electrical charges which are present are shunted off through the layer to the surface of the drum which is electrically conductive and which is also electrically connected to ground for this purpose. In prior art devices, the application of the electrical charge is accomplished by using the so-called Corona charging in which charges reach the surface of the layer on the rotating drum by means of spray discharge produced by high voltages. So as to have defined conditions, an equalization comprising a discharge of any charge that might be present on the surface of the layers is provided generally before carrying out the Corona charging.

The document to be copied is illuminated with a light of a first light source and with the help of corresponding optical devices copied onto the cover surface of the drum and specifically onto the surface of the layer on the drum. Since this exposing light is as is known has a wave length which falls above the absorption edge of the material of the layer, in other words, has shorter wave length than the absorption edge, photo-conductance is produced on locations of the layer which are exposed because of the document that was placed in the machine whereby an electrical charge which was previously applied by means of the Corona charge evenly over the whole surface will then flow away in a locally differentiated manner depending upon where patterns appear on the document. An electrical charge pattern remains on the surface of the layer which corresponds to the document. The locations on the surface of the layer which were not exposed lose their charge slowly because of the only very limited storage capactive of the material used and the material must, of course, simultaneously also manifest photo-conductive qualities. As an indication of the charge reduction, a decay time of 30 seconds normally results in the charge being down to one-half of its initial value.

The electrostatic charge pattern which is located on the surface of the drum is subsequently used for the copying of a single copy by means of a well known copying mechanism by which the charge pattern is brought in contact with a blackening powder while the drum rotates and a powder which according to the system being used in each case adheres either on the location of the surface of the layer which are more strongly positive or on those which are more strongly negative in charge. Then the black powder is transferred to the paper.

After one copy has been removed from the drum it is common practice to equalize the entire surface of the layer on the drum by illuminating the entire surface of the drum which is revolving before carrying out a new Corona charge. To do this, radiation which has a shorter wave length relative to the absorption edge of the material of the layer is used. Absorption "edge" or "border" are synonyms.

SUMMARY OF THE INVENTION

In the present invention, the wave length or frequency of irridation is chosen which achieves the greatest change in the absorption curve illustrated in FIG. 3.

It is common practice to use selenium or corresponding photosensitive selenium compounds such as arsenic selenide, arsenic telluride, or photosensitive compounds such as polyvinylcarbazol. These materials have the quality that they are at first very quickly charged to a maximum charge value during the Corona charging and that then with further Corona spraying the amount of charge not only does not increase but even decreases due to a fatigue effect. An extended Corona charge or in other words one which is continued for too long a period leads to an effect which is disadvantageous and for this reason in prior art devices, the length of time of the Corona charging which must be carried out one time before each image projection and copying of a document is strictly limited in time.

After the end of the Corona charging, the amount of charge falls in darkness on a decay time of 30 seconds down to one-half of the original charge as cited above. The image projection of the document occurs as soon as possible to the beginning of the time span of this falling in charge and the single copy is printed quickly thereafter in prior art devices.

With the already cited light for equalization, a so-called regeneration of the materials of the layer occurs mainly in such a way that the Corona charge is eliminated by means of leakage paths for the current and the fatiguing process is ended and the material is regenerated into so as to speak the beginning condition from which the above cited time dependent sensitivity from the Corona charge occurs.

In order to produce several copies of one document with prior art devices for each copy the whole process of Corona charging, exposure of the document for the renewed production of the charge pattern on the surface of the layer each time and the printing process is accomplished for each additional copy in the same manner as it was for the first copy. Thus, in the case of multiple copies, the document must remain in the machine until the time of the reproduction of the charge pattern which is used for the printing of the last copy is completed and only then can the document be removed and a new document which is to be copied be placed into the machine.

It is an object of the present invention to provide a device for electrophotographically copying which is similar to the above described types, but in which the document can be removed after the drum layer has been exposed for a single time and then the printing of multiple copies can occur with the singly exposure which was made and the next document to be printed can be placed into the machine prior to the time that the last copy of the previous document is reproduced.

Thus, with the present invention, the reproduction time is substantially decreased since the next document to be printed for multiple copies can be placed into the machine during a time when the machine is still printing copies from the prior document.

With the device according to the invention, numerous copies of a document can be produced in a simple manner even when the document is available for only a short time such as, for example, a television image on a television program which exists only for a short time. In the device according to the invention, the charge pattern which has been formed from the document, can be used several times directly for making multiple copies.

An additional advantage of the invention, lies in the fact that one can eliminate a longer time span between the electrostatic write-in process and the printing process such as in the cases when the decision to print comes only at the time between the collection of the information and the time of the completion of printing. With the invention the possibility of utilization as an eraseable information storage is available.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

According to the present invention, the illumination of the document in the machine is carried out as compared to the prior art with light having a wave length or a wave length range which is longer in wave length than the absorption edge of the layer material on the drum as was defined before. In contrast to the present invention, in the prior art for the exposure of the document, radiation which has a shorter wave length relative to the absorption edge is utilized. For example, according to the publication "The 4th International Congress for Reprograph and Information" 1975, Page 93 and following and in U.S. Pat. No. 3,511,649, discloses machines and process which use the so-called greenish blue copy lamps and it is stated that such lamps should not have a high proportion of red radiation in their outputs. Thus, in the present invention, on the other hand, the document is exposed with light having longer wave length than the absorption edge and, thus, the physical processes of the present invention are completely different from those which are used in the prior known art systems and process.

Figure 1:
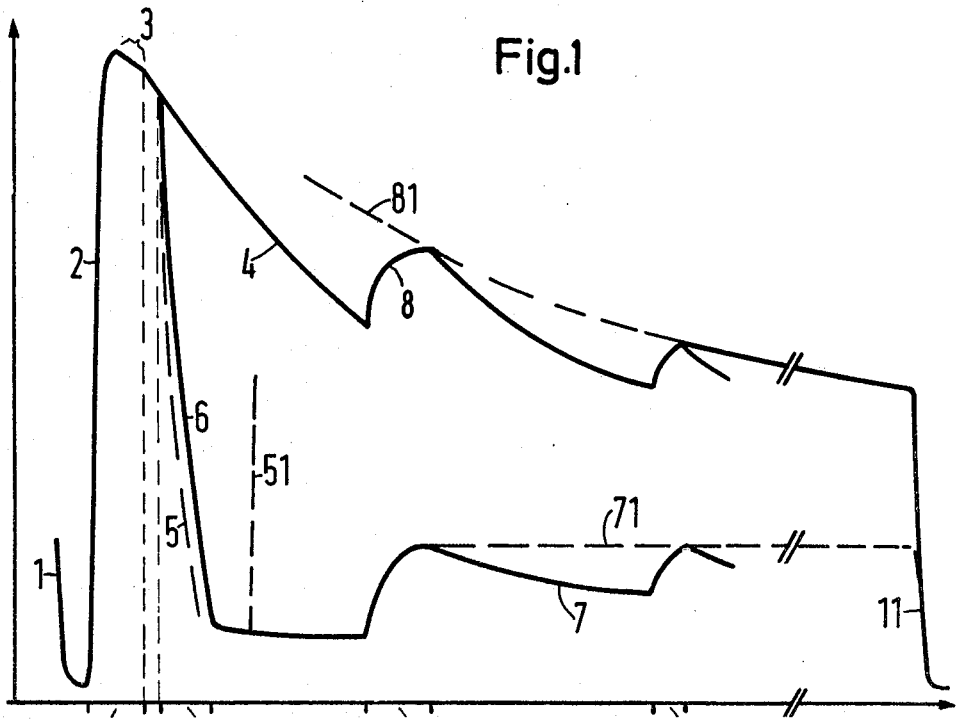
FIG. 1 is a diagram which serves for explaining the invention for charging and discharging the layer under the influence of illumination and Corona charging.

FIG. 1 will be used for a short explanation of the scientific basis of the invention. The curve comprising portions 1, 2 and 3 illustrate the manner of behaviour of the material which is found on the photo-conductive layer mounted on the drum. Curve portion 1 indicates a decrease in the charge as is common through the irradiation of, for example, green light for the purpose of erasing or equalizing the charge so as to erase the exposure of the previous steps in the process and is also carried out in certain instances in the present invention. The ascending curve portion 2 illustrates the increase of charge which is achieved in the layer depending on the time during which the Corona spraying on of charges occur. From the maximum point from the transition into the curved portion 3 and onward, a degree of fatigue in material is noticeable and can be clearly seen in the curve portion 3. It is known that the Corona spraying on at the prescribed intensity will not increase charges after a certain period of time and, thus, such charging is discontinued soon after the peak is passed.

After the end of the Corona charging, the decrease in the charge which occurs in the darkness follows approximately the curve segment designated by 4. Upon illumination as with a document to be copied, a decrease in charge occurs on the other hand at the illuminated locations as represented by a curve segment 5. The difference between curve segments 4 and 5 illustrate the contrast which is attainable according to processes of the prior art and this contrast can be achieved in the copy to be produced. In the prior art at the time when the curve segment 5 has reached a minimum point the production of the copy is made. The charge pattern which is produced by means of illumination on the drum is then erased after the copy has been made by means of beaming a green light, in other words, a light which has a shorter wave length relative to the absorption edge of the surface layer and this is indicated by curve segment 11 in FIG. 1. It should be noted that curve segment 1 and curve segment 11 are substantially identical.

According to the invention, a beam of light is to be used for producing the image on the layer and the beam is used which relative to prior art devices produces a completely different result. An image projection of the document onto the layer on the drum to provide local differentiation of charges and which is selected to be red light which has a longer wave length than the absorption edge of the layer produces a decrease in the charge of the exposed areas such as shown by curve segment 6 in FIG. 1. At the unexposed locations, the decrease remains according to the curve segment 4. The contrast which is attainable in the invention has the same value in practice as those of the prior art even though there may be a very slight change in the speed of decrease with red light according to curve segment 6, as a practical matter, curves 5 and 6 are so close together this light difference does not effect the reproduction quality. The contrast which arises in the charge pattern according to the invention depends upon the difference between the curve segments 4 and 6. A first copy of the document can be made just as in the case of the prior art by using the charge pattern which is produced after the exposure shown by the curve segment 6.

Also in the present invention, just as in the prior art, there occurs spreading of charge with further revolving of the drum as the portions of the surface of the drum pass by the device for the Corona spraying since this device continuously sprays charges onto the drums as in the prior art while the drum is rotating. It is to be noted, however, that in the invention a drop in charges to the same level according to curve segment 11 does not necessarily occur after the first copy has been made as in the case of the prior art. In fact, it is unexpected and surprising that no essential new charging up of the surface segments of the drum surface which have been exposed with a beam of light in the red range according to the invention occurs with the renewed Corona spraying. On the contrary, during the Corona spraying of the exposed portions of the surface of the drum, the charging up occurs according to the curve segment 7 in the invention. From the curves in FIG. 1, it is obvious that thus no essential increase in the charge situation occurs on the portions of the drum surface which have been exposed with red light. There is no minimal recharging which occurs according to curve segment 8 as occurs in the prior art but those portions of the surface element of the layer which have been radiated with red light according to the invention stay on the curve segment 7. On the unexposed portion recharging will reach up only approximately to a height of the charge which is reproduced up to the envelope curve 81 shown in dashed line which represents an indication of fatigue as described above. The limiting curve 31 is essentially a time continuation of the curve portion 3.

Numeral 71 illustrates a lower limiting curve which presents essentially the condition of charge at the locations which were previously exposed with red light according to the invention and curve 71 indicates a condition of charge which results from continuing Corona spraying on of charges on the portions exposed by a red light. The intermittent Corona spraying of the cover surface of the drum corresponding to the revolving of the drum and variations in the condition of the charge as they actually are at the moment correspond to the enveloping curves 71 and 81 but the significant point is than even with additional Corona spraying, the exposed portions according to the invention which have been exposed by long wave length light relative to the absorption edge of the layer on the drum are not erased but provide contrast between the exposed portion and the unexposed portions.

It is important to note an essential difference of the present invention relative to the prior art in that if rather than exposing the document with longer wave length of light such as red light one were to use the shorter wave length green light radiation such as in the prior art, an increase in the charge of the exposed portion would follow the curve segment 51 when additional spraying of the charges during the Corona spraying occurred. In other words, the contrast which is obtained with the invention and which is indicated by the space between the curves 71 and 81 would immediately disappear if the original exposure had been made with green light as in the prior art rather than with red long wave length light relative to the absorption edge of the layer as in the present invention and, thus, additional copies beyond the first copy could not be made as with the present invention.

Thus, in the invention, the charge pattern which has been produced by exposure with long wave length red light, remains in existence over a long period of time than in the prior art and even additional further Corona spraying of charges does not destroy such latent image and the image remains for a time which is sufficient to allow a number of copies of the original document to be reproduced without additional exposures of the original document. As was explained, before, a new copy of the same stored charge pattern can be reproduced in the time which corresponds to a revolution of the rapidly revolving drum.

By beaming light which has a shorter wave length relative to the absorption edge of the layer on the drum according to the curve segment 11, the latent image can be erased and the production of copies of the first document can be ended and the drum surface prepared for accepting a new charge pattern during the exposure of a second new document. During the time when additional copies are being produced the operator has enough time to exchange the first document for the second document and with the invention generally if production of ten copies each are made of a given document, a saving in time of at least one-half can be made. In other words, the machine according to the invention can produce twice as many copies due to the saving in time made by the operator changing the documents during the time when the machine is still printing copies from the prior document.

An additional invention comprising a new method of simultaneously copying two documents has also been invented. Such simultaneous copies can be understood for example, if a first document such as a form together with a second document are laid out into a common copy. The form document, for example, the form for a settling of an account or for a questionnaire is according to the invention written as a charge pattern onto the layer on the drum with longer wave length light energy relative to the absorption edge of the material. As described above, this charge pattern will be retained according to the contrast between the curves 71 and 81 for a period of time sufficient to obtain numerous copies.

By subsequently switching the wave length of the light source, according to the invention, which used longer wave length radiation, to shorter wave length radiation relative to the absorption edge or alternatively, through the use of an additional light source which is provided for the erasing procedure according to curve segment 11 which produces shorter wave length radiation relative to the absorption edge or through a further radiation source producing a beam which has a shorter wave length relative to the absorption edge, an image projection of a second document can be accomplished and a second image can be projected into the first image of the document which may be a form. This is accomplished by revolving the drum for example, with an angular and a corresponding time shift which for the purposes of the invention is to be understood as the meaning of simultaneous. The second document can, for example, have a completely different individual information content which need only be in one copy. With every revolution of the drum a new second document is, for example, projected into the blank spaces of the stored charge pattern of the first document which is a form. Even without using erasing, which is known from the prior art according to the curve segment 11, the desired exchange of information can be carried out according to the second document, each time in the charge pattern as a result of the spray charging which continues intermittently with the revolving of the drum as provided in the invention. In other words, in this embodiment, the latent image formed by the first document which is made with long wave length light remains on the drum until such latent image is erased as in the first embodiment and, thus, the first document will be repeatedly printed as the drum rotates. On the other hand, the second document which is exposed with light energy of shorter wave length relative to the absorption edge of the layer on the drum will be erased each time the Corona spraying occurs such that additional second documents can be exposed on each rotation.

Figure 2:
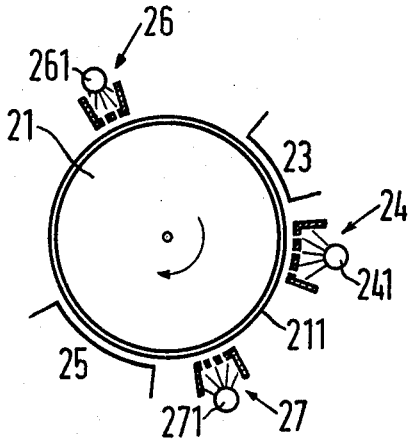
FIG. 2 is a schematic end plan view of the invention.

FIG. 2 schematically illustrates a device according to the invention wherein a drum 21 upon which a photosensitive layer 211 is mounted for reproducing copies. The layer 211 is not described in greater detail because such layers are known in the prior art. The drum rotates in the direction indicated by arrow 22. Apparatus 23 provides a Corona charge spraying of the layer 211. An exposure device 24 is shown schematically and allows a projection of the image of the document to be placed on th surface of the drum. The difference between the exposure device 24 and those of the prior art is that instead of the prior art common light source which uses light energy having a shorter wave length relative to the absorption edge of the layer 211, a light 241 having an output radiation of longer wave length light such as red relative to the absorption edge is used with the layer 211 of selenium material. A printing device 25 of a known type is mounted adjacent the drum as shown and carries out the transfer process in the printing process for producing a copy of the original document on a sheet of paper. An erasing device 26 in which a light source 261 is mounted which produces light energy so as to provide erasing according to the curve segments 1 and 11 in FIG. 1 which can be projected onto the surface of the drum for erasure purposes. An exposure device 27 is used in the further development of the invention described above as simultaneous copying and the device 27 can project an image from a second document and includes an additional light source 271. The light source 271 of the projecting device 27 differs from the light source in the projecting device 24 of the invention in that it produces a shorter wave length beam relative to the absorption edge of the layer 211 which results in the effect illustrated by curve segments 5 and 51 when the spraying of charges occurs again in the next revolution of the drum.

Figure 3:
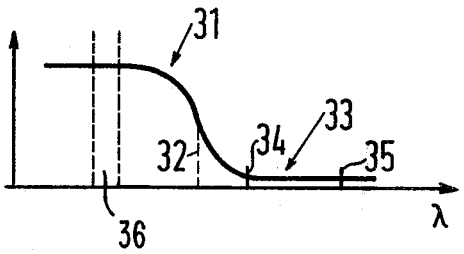
FIG. 3 is a diagram illustrating a plot of the wave length for explaining the invention.

FIG. 3 is a curve illustrating the choice of wave lengths of the light beams which are to be used in the invention and particularly together with the absorption curve for an arsenic selenide compound as the layer 211. Curve 31 designates the essential characteristic of an absorption curve of the material 211 which includes the absorption border. The absorption border 32 is sometimes referred above as an absorption edge but in this specification absorption border or absorption edge are identified by the steeply dropping portion of the curve as, for example, at point 32 in FIG. 3. Portion 33 of the curve illustrates in an exemplary manner a range of wave lengths which has the lower limit starting with the absorption border 32 and according to the invention is used for the first light source 241 for the exposure of the documents and recording of the charge pattern. The portion 36 of the curve 31 illustrates a range of wave lengths as an example as is used for erasing the charge pattern according to curve segments 1 and 11 and it is used in the prior art for recording the charge patterns. In the present invention, however, the wave length range 33 as, for example, between 34 and 35 which are longer in wave length than the absorption border or edge 32 are used to obtain the advantages of the invention.

Although the invention has been described with respect to preferred embodiments thereof, it is not to be so limited as changes and modifications may be made therein which are within the full intended scope as defined by the appended claims.

We claim as our invention:

1. A device for electrophotographic copy process especially for the production of several copies of one document, with a single exposure, having a rotatable drum including a layer which is capable of storing electrical charge in darkness and is photo-conductive when illuminated, including a device for a Corona charging of the layer during each revolution of the drum, and including a first light source for illumination of a first document, including a toner powder supplying means, and means for feeding in paper and for printing on said paper and having a second light source for equalization of the electrical charges over the entire area of the layer, characterized in that the first light source (241) produces a light in a limited wavelength range (33), whose lower limit (34) lies near the absorption border (32) of the material of the layer (211) and on the translucent, longer wave length side of said absorption border.

2. A device as claimed in claim 1, characterized in that the material of the layer (211) is a photosensitive selenium compound and/or an organic photoconductor.

3. A device as claimed in claim 1 characterized in that a third light source (271) for illumination of a second, other document is provided for a simultaneous copying operation which includes a light source having a wavelength range equivalent that of said second light source.

4. A device as claimed in claim 3, characterized in that the third light source (271) and the second light source (261) are the same light source.

5. A method of electrophotographic copying for the production of several copies of one document with a revolvable drum having a layer which stores electrical charge in darkness and is photo-conductive when illuminated, comprising the steps of charging the cover surface of a drum (21) by Corona spraying with device (23) the cover surface of said drum to charge said surface, projecting a latent image of a first document with a first light source (241) with light of a longer wave length (33) than the absorption border (32) of the material of the layer (211) onto the layer (211) for producing a first copy of the first document with the reproduction mechanism (25) and producing with each additional revolution of the drum from the first charge pattern which remains on the layer (211) further copies of said first document with the reproduction mechanism (25) without re-exposure of said first document, and then erasing the latent image by equalizing the electrical charge of the layer (211) with a second light source (261).

6. A process as claimed in claim 5, characterized in that for a simultaneous copying operation during each revolution of the drum (21) a second latent image is produced of a second document with a third light source (27) having radiation with a wavelength range equivalent to that of said second light source and is capable of recording a second charge pattern, and said second charge pattern is erased during each revolution of the drum (21) by the Corona spraying device (23).

7. A method of electrophotographically reproducing copies of a document having a drum with a layer on its surface capable of storing charges and having photoconductive properties and exhibiting an absorption border, said method comprising spraying Corona charge onto said layer of said drum surface to charge it during each revolution of said drum, exposing a document once during a first revolution of the drum with energy having a longer wave length than said absorption border to form a latent image on said layer, and printing a plurality of copies of said document from said latent image with one copy being formed during each succeeding revolution of said drum.

8. The method of claim 7 including means for selectively irradiating said layer with energy having a wave length shorter than the absorption border so as to erase said latent image.

9. Apparatus for producing a plurality of copies of a document with only a single exposure of said documents comprising, a drum supported for rotatable motion, a layer on the surface of said drum capable of storing charges and having photo-conductive properties, Corona discharge means mounted adjacent said drum to spray charges on said surface as it rotates before it is exposed, means for projecting an image of a document, which it is desired to be reproduced onto the surface of said drum, with energy having a longer wave length than the absorption border of said layer to form a latent image in said layer, means for printing said latent image to form a plurality of copies of said document from said latent image, and means for selectively irradiating said latent image with energy having a wave length shorter than said absorption border so as to erase said latent image after said printing is completed.

* * * * *